US008814562B2

(12) United States Patent
Jensen et al.

(10) Patent No.: US 8,814,562 B2
(45) Date of Patent: Aug. 26, 2014

(54) IGNITER/THRUSTER WITH CATALYTIC DECOMPOSITION CHAMBER

(75) Inventors: Jeff Jensen, Reseda, CA (US); Scott Claflin, West Hills, CA (US)

(73) Assignee: Aerojet Rocketdyne of DE, Inc., Canoga Park, CA (US)

( * ) Notice: Subject to any disclaimer, the term of this patent is extended or adjusted under 35 U.S.C. 154(b) by 1008 days.

(21) Appl. No.: 12/131,840

(22) Filed: Jun. 2, 2008

(65) Prior Publication Data

US 2009/0297999 A1 Dec. 3, 2009

(51) Int. Cl.

| | |
|---|---|
| ***F23C 3/00*** | (2006.01) |
| ***F23Q 9/08*** | (2006.01) |
| ***F23Q 11/00*** | (2006.01) |
| ***F41F 3/04*** | (2006.01) |
| ***F02C 7/26*** | (2006.01) |
| ***C06D 5/00*** | (2006.01) |

(52) U.S. Cl.

CPC ..... *F23Q 11/00* (2013.01)
USPC ..... 431/158; 431/42; 431/47; 431/268; 89/1.813; 60/39.821; 60/211; 60/212

(58) Field of Classification Search

USPC ..... 60/211, 212, 39.821; 89/1.813; 431/268, 42, 47, 158
See application file for complete search history.

(56) References Cited

U.S. PATENT DOCUMENTS 3,062,004 A * 11/1962 Dooley et al. ..... 60/39.27
3,630,150 A 12/1971 Rakowsky
3,651,644 A * 3/1972 Breen et al. ..... 60/203.1
3,811,359 A 5/1974 Marchese et al.
3,854,401 A 12/1974 Fisher
3,871,828 A * 3/1975 Ellion et al. ..... 422/607
3,948,175 A 4/1976 Bucklisch
3,948,697 A 4/1976 Flanagan et al.
3,954,526 A 5/1976 Mangum et al.
3,982,488 A 9/1976 Rakowsky et al.
3,994,226 A 11/1976 Rakowsky et al.
3,994,232 A 11/1976 Rakowsky et al.
4,027,476 A * 6/1977 Schmidt ..... 60/218
4,033,115 A 7/1977 Baits
4,036,581 A 7/1977 Keyser et al.
4,429,534 A 2/1984 Joy
4,441,156 A 4/1984 Barbeau
4,459,126 A * 7/1984 Krill et al. ..... 431/7
4,488,856 A 12/1984 Preble et al.
4,638,173 A 1/1987 Milton
4,664,134 A 5/1987 Pera
4,697,238 A 9/1987 Barbeau
4,697,524 A 10/1987 Penner et al.
H0372 H 11/1987 Campbell
4,704,865 A 11/1987 Archung
4,711,089 A 12/1987 Archung
4,777,793 A 10/1988 Weigand et al.

(Continued)

OTHER PUBLICATIONS

Vadim Zakirov, Oct. 11, 2000, Nitrous Oxide Catalytic Decomposition, Surrey Satellite Technology, Reference No. SPAB-17101-01, Whole Document.*

*Primary Examiner* — Kenneth Rinehart
*Assistant Examiner* — William Corboy
(74) *Attorney, Agent, or Firm* — Joel G. Landau

(57) ABSTRACT

An ignition system and method of igniting the ignition system includes a main catalyst section in a staged relationship with a pilot-catalyst section to stage a decomposition though the pilot-catalyst section which preheats the main catalyst section.

1 Claim, 2 Drawing Sheets

(56) References Cited

U.S. PATENT DOCUMENTS

| | | | | | |
|---|---|---|---|---|---|
| 4,800,716 | A | | 1/1989 | Smith et al. | |
| 4,892,037 | A | | 1/1990 | Betts | |
| 4,893,815 | A | | 1/1990 | Rowan | |
| 4,899,956 | A | | 2/1990 | King et al. | |
| 4,912,921 | A | | 4/1990 | Rice et al. | |
| 4,916,904 | A | | 4/1990 | Ramsaier et al. | |
| 4,938,139 | A | | 7/1990 | Brede et al. | |
| 4,953,440 | A | | 9/1990 | Moscrip | |
| 5,022,324 | A | | 6/1991 | Rice, Jr. | |
| 5,052,817 | A | | 10/1991 | Bement et al. | |
| 5,080,305 | A | | 1/1992 | Stencel | |
| 5,115,638 | A | | 5/1992 | Reed et al. | |
| 5,208,575 | A | | 5/1993 | Temple | |
| 5,214,911 | A | | 6/1993 | Shekleton | |
| 5,220,783 | A | | 6/1993 | Cherry et al. | |
| 5,271,226 | A | | 12/1993 | Stone | |
| 5,321,327 | A | | 6/1994 | Jensen | |
| 5,431,010 | A | | 7/1995 | Stone | |
| 5,485,788 | A | | 1/1996 | Corney | |
| 5,536,990 | A | | 7/1996 | Nelson | |
| 5,582,806 | A | * | 12/1996 | Skanberg et al. | 422/305 |
| 5,685,504 | A | | 11/1997 | Schneider et al. | |
| 5,694,764 | A | | 12/1997 | Blain et al. | |
| 5,765,361 | A | | 6/1998 | Jones et al. | |
| 5,787,685 | A | | 8/1998 | Miller, II et al. | |
| 5,797,737 | A | * | 8/1998 | Le Gal et al. | 431/170 |
| 6,050,085 | A | | 4/2000 | Mayer | |
| 6,066,898 | A | | 5/2000 | Jensen | |
| 6,082,098 | A | | 7/2000 | Park et al. | |
| 6,199,365 | B1 | | 3/2001 | Pretorius et al. | |
| 6,226,980 | B1 | | 5/2001 | Katorgin et al. | |
| 6,244,040 | B1 | | 6/2001 | Adzhian et al. | |
| 6,244,041 | B1 | | 6/2001 | Vasin et al. | |
| 6,253,539 | B1 | | 7/2001 | Farhangi et al. | |
| 6,255,009 | B1 | | 7/2001 | Rusek et al. | |
| 6,269,630 | B1 | | 8/2001 | Kreiner et al. | |
| 6,272,845 | B2 | | 8/2001 | Kessaev et al. | |
| 6,272,846 | B1 | * | 8/2001 | Schneider | 60/218 |
| 6,272,847 | B1 | | 8/2001 | Dietrich | |
| 6,274,945 | B1 | | 8/2001 | Gilbreth et al. | |
| 6,302,683 | B1 | * | 10/2001 | Vestin et al. | 431/7 |
| 6,381,949 | B1 | | 5/2002 | Kreiner et al. | |
| 6,446,909 | B1 | | 9/2002 | Michelson | |
| 6,453,937 | B1 | | 9/2002 | Tobias | |
| 6,469,424 | B1 | | 10/2002 | Marable | |
| 6,470,670 | B2 | | 10/2002 | Maeding | |
| 6,505,463 | B2 | | 1/2003 | Kruse et al. | |
| 6,536,208 | B1 | | 3/2003 | Kretschmer | |
| 6,568,171 | B2 | | 5/2003 | Bulman | |
| 6,655,127 | B2 | | 12/2003 | Kruse et al. | |
| 6,664,653 | B1 | | 12/2003 | Edelman | |
| 6,679,155 | B1 | | 1/2004 | Yaschur et al. | |
| 6,758,199 | B2 | | 7/2004 | Masters et al. | |
| 6,769,242 | B1 | | 8/2004 | Balepin | |
| 6,829,899 | B2 | | 12/2004 | Benham, Jr. et al. | |
| 6,880,491 | B2 | | 4/2005 | Reiner et al. | |
| 6,887,821 | B2 | | 5/2005 | Mays et al. | |
| 6,918,243 | B2 | | 7/2005 | Fisher | |
| 6,935,241 | B2 | | 8/2005 | Hudelmaier et al. | |
| 6,959,893 | B1 | | 11/2005 | Sadowski et al. | |
| 6,966,769 | B2 | | 11/2005 | Evlander et al. | |
| 2001/0015063 | A1 | | 8/2001 | Maeding | |
| 2003/0046923 | A1 | | 3/2003 | Dressler et al. | |
| 2004/0148923 | A1 | | 8/2004 | Hewitt | |
| 2004/0148925 | A1 | | 8/2004 | Knight | |
| 2004/0177603 | A1 | | 9/2004 | Hewitt | |
| 2007/0169461 | A1 | * | 7/2007 | Koerner | 60/39.12 |
| 2008/0173020 | A1 | * | 7/2008 | Mungas et al. | 60/752 |
| 2008/0264372 | A1 | * | 10/2008 | Sisk et al. | 123/144 |
| 2009/0007541 | A1 | * | 1/2009 | Kawaguchi et al. | 60/220 |

* cited by examiner

IGNITER/THRUSTER WITH CATALYTIC DECOMPOSITION CHAMBER

BACKGROUND

The present invention relates to an igniter system, and more particularly to an igniter system with a catalytic decomposition chamber.

Ignition of non-hypergolic propellants requires an external ignition system. Various conventional ignition systems include spark igniters, augmented spark igniters (ASI), pyrotechnique (flare rod), hypergol slug cartridge and combustion wave igniters (CWI). These conventional ignition systems, although effective, may tend to be relatively heavy, complex and limited to short active duration.

SUMMARY

An ignition system for a combustion device according to an exemplary aspect of the present invention generally includes a pilot-catalyst section along an axis and a main catalyst section in a staged relationship with said pilot-catalyst section along said longitudinal axis.

A method of igniting an igniter system according to an exemplary aspect of the present invention generally includes supplying a propellant to an igniter, the propellant having a Nitrous Oxide (N2O).

A method of igniting an igniter system according to an exemplary aspect of the present invention generally includes staging decomposition though a pilot-catalyst section which preheats a main catalyst section adjacent to the pilot-catalyst section.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF DISCLOSED EMBODIMENTS

Figure 1:
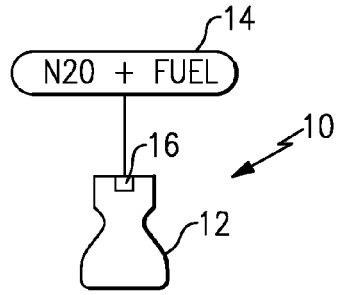
FIG. 1 is a general schematic block diagram view of an exemplary combustor system embodiment for use with one non-limiting embodiment of the present invention.

FIG. 1 illustrates a general schematic view of a combustor system 10. The combustor system 10 generally includes a combustion chamber assembly 12, a propellant system 14, and an ignition system 16. It should be understood that although a rocket engine combustor system is disclosed in the illustrated embodiment, other rocket engines, airbreathing engines, power generators and steam generators where reliable ignition, high efficiency combustion, compact size and robust durability are required will also benefit from the present invention. Further, other self-contained combustor systems including low-impulse rocket motors, such as reaction control thrusters, as well as other self-contained combustor systems, such as cutting torches, will also benefit herefrom.

Figure 2:
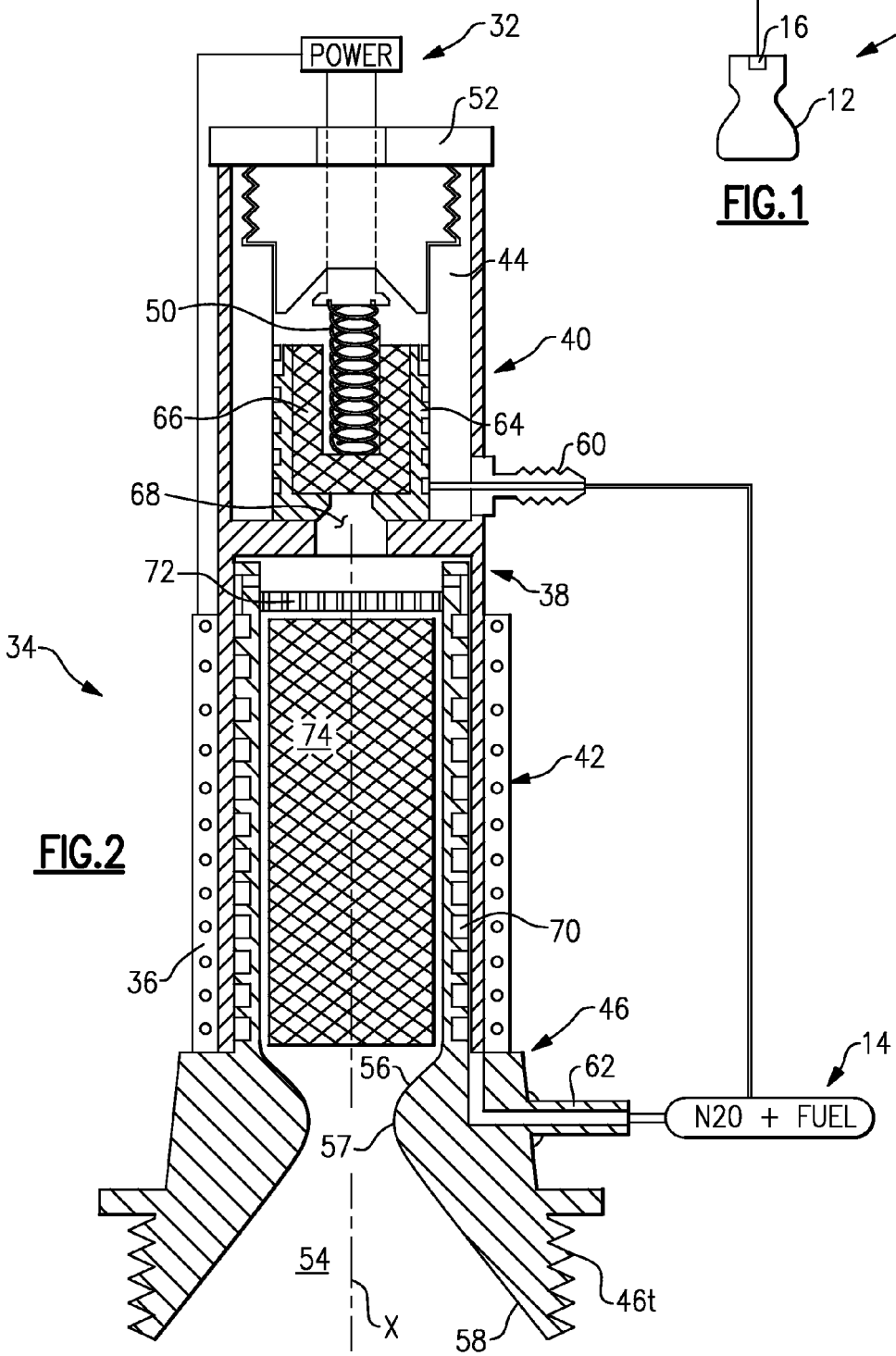
FIG. 2 is a longitudinal sectional view of an ignition system with a catalytic decomposition chamber.

Referring to FIG. 2, the ignition system 16 generally includes a power source 32 and an igniter 34. The power source 32 may include a battery or other electrical generator systems which provides electrical power to the igniter 34. The power source 32 may additionally provide electrical power to a heater system 36 which may surround at least a section of an igniter housing 38.

The igniter 34 includes a pilot-catalyst section 40 and a main catalyst section 42 in a staged relationship along a longitudinal axis X. The pilot-catalyst section 40 includes a pilot housing 44 mounted or integrated with a main housing 46 of the main catalyst section 42. The pilot housing 44 and the main housing 46 together may form at least a portion for the igniter housing 38.

A thermal element 50 such as an electric coil, glow plug or other such electric powered element is mounted within a heater element housing 52. The heater element housing 52 may be threaded, welded or otherwise integrated with the igniter housing 38 at one end section of the pilot housing 44 opposite the main housing 46.

The main housing 46 forms a nozzle 54 having a combustor section 56, a nozzle section 58, downstream of the combustor section 56 and a throat section 57 therebetween. The main housing 46 may include a threaded section **46*t* to mount the igniter 34 to another component. Generally, the various applications for the igniter may be specifically tailored through application of a particular nozzle type 54**, e.g., the nozzle for an igniter may be different than a nozzle for a thruster and different from a nozzle for a cutting torch or other such application.

The pilot housing 44 includes a pilot inlet 60 and the main housing 46 includes a main inlet 62 to receive a propellant from the propellant supply 14. The pilot inlet 60 may receive approximately thirty percent of the propellant while the main inlet 62 may receive approximately seventy percent. It should be understood that other percentages, such as a ten percent difference, may alternatively be provided. The propellant may include Nitrous Oxide (N2O) singularly or with relatively small amount of fuel supplied therewith. The N2O is homogenous with the fuel and the quantity of fuel supplied is controlled to assure that the propellant supplied to the pilot inlet 60 and the main inlet 62 remains below the detonation limit. One example of a fuel is hydrogen ($H_2$), however, methane or other fuels or combinations of fuels may alternatively or additionally be utilized. The inclusion of fuel will further lower the initial reaction decomposition temperature and simplify the catalyst system. The fuel reacts with the N2O over the catalyst at a much lower temperature than pure N2O (comparable to Tridyne).

The propellant is communicated into a pilot catalyst material bed 66 of the pilot-catalyst section 40 through a pilot regenerative cooling jacket 64, which is heated with the thermal element 50 to initiate decomposition. The pilot catalyst material bed 66 decomposes the N2O into a high temperature pilot gas effluent that exits the pilot catalyst bed 66 through a pilot outlet 68 in communication with the main catalyst section 42 to heat a main catalyst bed 74 with the high temperature pilot gas effluent from the pilot catalyst material bed 66.

The propellant is also communicated into the main catalyst section 42 through the main inlet 62 and a main regenerative cooling jacket 70. The propellant from the main regenerative cooling jacket 70 mixes with the high temperature pilot gas effluent that exits the pilot catalyst bed 66 through the pilot outlet 68 and passes through a distribution plate 72 into the main catalyst bed 74. The pilot catalyst bed 66 and the main catalyst bed 74 may be manufactured of the same or different material. Some example materials in this non-limiting embodiment may be selected from the Platinum metal group such as Rhodium, Rhenium, Platinum, Iridium, Palladium and Osmium, and/or materials from Groups 7/8/9/10 such as Iron Oxide, Cobalt Oxide, Nickel Oxide, Manganese Oxide, Rhodium Oxide, and Rhenium Oxide, however, other materials may alternatively or additionally be utilized.

The high temperature pilot gas effluent from the pilot-catalyst section 40 preheats the main catalyst bed 74 to initiate the main propellant flow decomposition. The propellant from the main inlet 62 is thereby decomposed by exposure to the main catalyst bed 74 to produce the desired jet of hot oxygen and hot nitrogen gases which will function, for example only, as an igniter to ignite the main propellants of a rocket engine, missile system, provide thrust as a monopropellant for a satellite thruster, provide an oxidizer for bi-propellant systems, or drive a gas turbine. Still other applications may include igniter replacement for hypergolic fluid, Triethylaluminum and Triethylborane (TEA/TEB), low temperature, non-toxic ignition devices for ramjets or rockets, hot oxygen generators, and compact, storable, generation of breathable mixtures of O2 and N2 and cutting torch operations.

Figure 3:
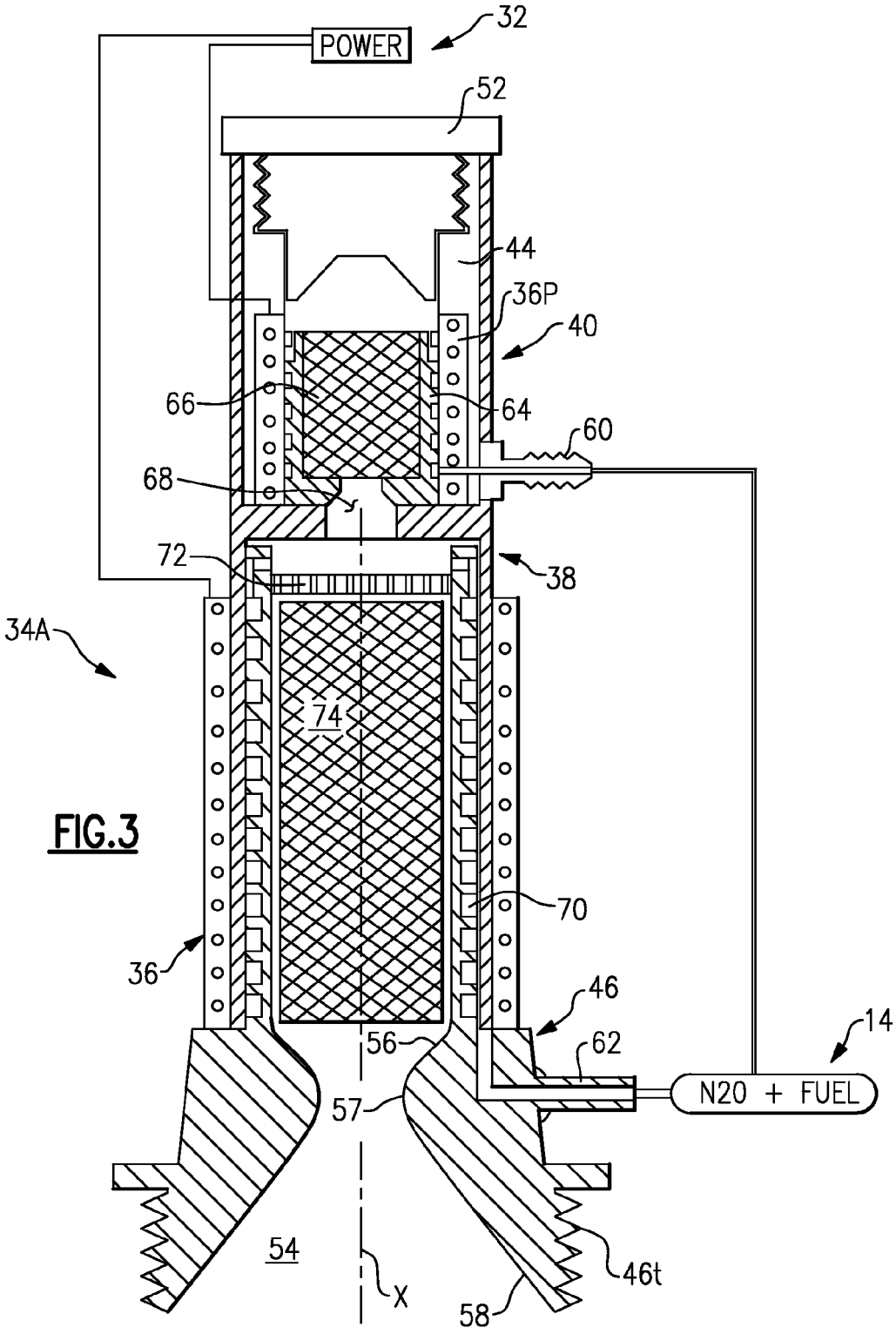
FIG. 3 is a longitudinal sectional view of another ignition system with a catalytic decomposition chamber

Referring to FIG. 3, another igniter 34A utilizes the heater system 36 to replace the thermal element 50. That is, the heater system 36 includes a pilot-catalyst section heater 36P which surrounds the pilot-catalyst section 40. The pilot-catalyst section heater 36P thereby heats the pilot catalyst bed 66 to initiate decomposition as generally described above.

In another non-limiting embodiment, the igniter 34 is operated as a monopropellant thruster capable of a theoretical specific impulse as represented in FIG. 3.

It should be understood that relative positional terms such as "forward," "aft," "upper," "lower," "above," "below," and the like are with reference to the normal operational attitude of the vehicle and should not be considered otherwise limiting.

It should be understood that although a particular component arrangement is disclosed in the illustrated embodiment, other arrangements will benefit from the instant invention.

Although particular step sequences are shown, described, and claimed, it should be understood that steps may be performed in any order, separated or combined unless otherwise indicated and will still benefit from the present invention.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. An ignition system comprising:

a pilot-catalyst section along a longitudinal axis;

a pilot inlet in communication with said pilot-catalyst section to receive a propellant;

a main catalyst section in a staged relationship with said pilot-catalyst section along said longitudinal axis;

a main inlet in communication with said main catalyst section to receive the propellant;

wherein said pilot-catalyst section includes a pilot catalyst bed;

wherein a pilot outlet is downstream of said pilot catalyst bed relative to said longitudinal axis, said main catalyst section in communication with said pilot outlet;

wherein said pilot-catalyst section includes a pilot regenerative cooling jacket, said pilot catalyst bed in communication with said pilot inlet via said pilot regenerative cooling jacket; and wherein the main catalyst section includes a main catalyst bed, and wherein the main catalyst section includes a main regenerative cooling jacket, said main catalyst bed in communication with said main inlet via said main regenerative cooling jacket, and wherein said main catalyst bed is in communication with said pilot outlet.

* * * * *